United States Patent [19]

Moser

[11] Patent Number: 4,750,572

[45] Date of Patent: Jun. 14, 1988

[54] DRILLING TOOL WITH AN INTERCHANGEABLE CONVEYING SPIRAL

[75] Inventor: Bernhard Moser, Altshausen, Fed. Rep. of Germany

[73] Assignee: Hawera Probst GmbH & Co., Ravensburg, Fed. Rep. of Germany

[21] Appl. No.: 862,244

[22] Filed: May 12, 1986

[30] Foreign Application Priority Data

May 15, 1985 [DE] Fed. Rep. of Germany ... 8514422[U]

[51] Int. Cl.[4] ..... E21B 17/22; E21B 17/046

[52] U.S. Cl. ..... 175/323

[58] Field of Search ..... 175/323, 321; 408/226

[56] References Cited

U.S. PATENT DOCUMENTS

| | | | |
|---|---|---|---|
| 1,116,154 | 11/1914 | Stowers | 175/323 |
| 2,116,359 | 5/1938 | McCann | 175/323 X |
| 2,400,478 | 5/1946 | Beck | 175/323 X |
| 2,675,257 | 4/1954 | Specht | 403/328 |
| 2,831,659 | 4/1958 | Kukuchek et al. | 175/323 |
| 3,372,763 | 3/1968 | Fisher | 175/323 |
| 4,393,947 | 7/1983 | Lutze et al. | 175/323 |

FOREIGN PATENT DOCUMENTS

| | | |
|---|---|---|
| 665884 | 12/1965 | Belgium . |
| 2543578 | 7/1977 | Fed. Rep. of Germany . |
| 3044775 | 8/1982 | Fed. Rep. of Germany . |

*Primary Examiner*—Stephen J. Novosad
*Attorney, Agent, or Firm*—Spencer & Frank

[57] ABSTRACT

A drilling tool is proposed which is provided with an interchangeable conveying spiral and an axial supporting device of the conveying spiral. To achieve a cost-effective and simply constructed, but at the same time reliable axial support of the conveying spiral (14), an elastic sleeve (15) is held in a recessed groove (19) in the drill shank (11) against axial slipping by a support ring (17).

12 Claims, 1 Drawing Sheet

DRILLING TOOL WITH AN INTERCHANGEABLE CONVEYING SPIRAL

BACKGROUND OF THE INVENTION

1. Field of the Invention

The invention relates to a drilling tool with an interchangeable conveying spiral which is axially secured by means of a supporting device positively supported on the drill shank.

2. Discussion of the Prior Art

Attachable conveying spirals are known, for example, from German Offenlegungsschrift No. 2,543,578 or German Offenlegungsschrift 3,044,775 (U.S. Pat. No. 4,393,947). In the first mentioned specification, the conveying spiral is axially secured by means of a two piece clamping ring which can be fastened to the shank by means of screws. A further annular element is arranged between the circumference of the clamping ring and the circumference of the shank, and a further elastic member which acts as a cushion is arranged between the rear end of the spiral and the clamping ring. Therefore at least four different components are necessary in the object of this supporting device, and assembling or dismantling for exchanging the spiral is complicated. Moreover, the conveying spiral can be axially secured effectively only by extremely careful assembly.

In the embodiment of an axial supporting device according to the additionally quoted German Offenlegungsschrift No. 3,044,775, (U.S. Pat. No. 4,393,947) the conveying spiral, strictly speaking, is not axially secured at all, for the supporting devices defining the conveying spiral are primarily made as centering rings of rubber or plastic. When the conveying spiral is subjected to axial loading, such a component cannot axially secure the conveying spiral effectively.

In a further known device for axially securing a telescopic conveying spiral, a sleeve is used which can be axially displaced against the thrust of the spiral and, in the manner of a feather key, fixes the axial position of a part which positively interacts with the drill shank and the sleeve.

SUMMARY OF THE INVENTION

The object of the invention is to create a supporting device for axially securing an interchangeable conveying spiral which avoids the abovementioned disadvantages and which in particular is simply constructed and easily interchangeable and which ensures high reliability of the axial securing.

Compared with the known devices, the axial support according to the invention for attachable spirals has the advantage that it can be manufactured very cost effectively under the application of standards. Moreover, it does not generate any natural vibrations and has a vibration-damping or vibration-reducing effect on the drilling system as a result of the appropriate shaping. Assembly does not require an expensive special tool. Also advantageous is the universal applicability for an entire diameter range of drilling tools, that is, for various interchangeable conveying spirals and also for drilling tools which have different drill heads with constant shank diameter. The simple design results in a long life for the supporting device. The supporting device can be used in like manner for different spiral types, that is, with and without a jacket tube.

According to the design of the invention, an elastic sleeve is used as an axial supporting device, which sleeve positively engages into the recessed groove on the drill shank and therefore acts as both an axial securing device and a damping member of the drilling tool.

A further development of the invention in that the elastic sleeve is held in its axial position within the recessed groove by means of a support ring, clamping ring or the like. Therefore the outside diameter of the sleeve, for leaving the recessed groove, can expand only when the support ring is removed. Moreover, in an advantageous further development of the invention, the support ring itself can likewise be secured via a retaining shoulder against axial slipping. However, the clamping ring is normally fastened by means of pliers and nipped off or opened after use. According to the embodiment of the invention the rubber sleeve may be pressed down into the recessed groove by tightening the clamping ring.

BRIEF DESCRIPTION OF THE OF THE DRAWINGS

An advantageous and expedient exemplary embodiment of the invention is described in greater detail in the following description and shown in the drawing, in which:

FIG. 1 shows a longitudinal section through a drilling tool according to the invention with an axial supporting device, FIG. 2 shows a plan view in accordance with the section line I—I in FIG. 1.

DESCRIPTION OF THE PREFERRED EMBODIMENTS

Figure 1:
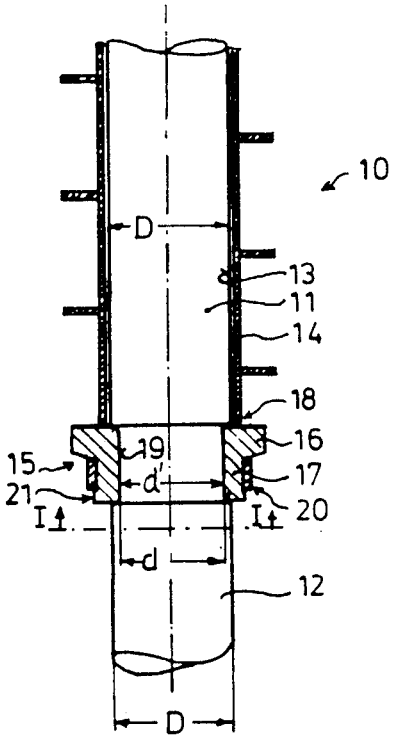

The drilling tool 10 shown in FIG. 1 consists of a drill shank 11 of diameter D. The lower, chucking shank 12 cut off in the Figure and the upper bearer shank 13 for the attachable conveying spiral 14 are separated by the supporting device 15 designed as a sleeve. The sleeve 15 made from elastic rubber or plastic is stepped in a T shape in cross section that is, it consists of an upper collar 16 larger in diameter and a lower collar 17 smaller in diameter.

For accommodating the sleeve 15, the drill shank 11 has a recessed groove 19 which extends axially from the lower edge 18 of the conveying spiral 14 and corresponds in its diameter d' to the inside diameter d of the sleeve 15. The inside diameter of the sleeve (d) is also approximately equal to the drill shank diameter (D). The inside diameter d of the sleeve 15, in the non-clamped condition, can be made slightly smaller than the diameter d' of the recessed groove 19 to enable an additional non-positive fastening. The upper edge of the spiral 14 (not shown) is supported by the drill head as is well known in the prior art discussed earlier.

The sleeve supports a clamping ring 20 via the lower collar 17, the inside diameter of which clamping ring 20 is of such a size that the sleeve, after engaging in the recessed groove 19, can no longer expand its outside diameter and therefore is limited to the the inside diameter d, so that the sleeve 15, after the clamping ring 20 is mounted, is definitely fixed in its axial position by positive connection. An additional non-positive connection between the sleeve 15 and the groove 19 results from the elasticity of the rubber sleeve.

The support ring 20 can be secured against sliding away axially by means of a small retaining shoulder 21 beneath the support ring 20, the outside diameter of which is made slightly larger than the inside diameter of the support ring.

The upper, wider collar 16 acts as a damping support for the conveying spiral 14.

Figure 2:
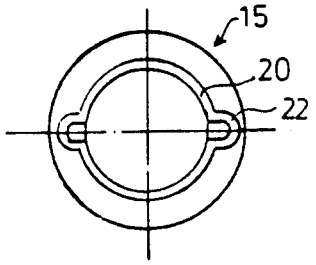

FIG. 2 schematically shows the supporting device or sleeve 15 from the view I—I in FIG. 1. This shows in particular the design of the support ring 20 as a two-lug hose clamp which is expediently used.

Assembling or dismantling the conveying spiral 14 on the drill shank then takes place as follows:

Assembly: The clamping ring 20 designed as a twolug hose clamp is made larger in diameter in the original condition than the outside diameter of the sleeve 15. After the ring is pushed on, it is pinched together at the "lugs" 22 with pincers, so that the ring diameter is reduced and the rubber sleeve is firmly pressed into the recessed groove 19. For dismantling, the clamping ring 20 is nipped off with pliers and removed.

In an embodiment with a retaining shoulder 21, the support ring 20 can be held in its position by the retaining shoulder itself, so that it cannot slide off. For dismantling, the support ring 20 is then removed via the retaining shoulder. The elastic sleeve 15 can then be increased in its inside diameter d and removed (downwards in FIG. 1) from the recessed groove 19 by axial displacement. The conveying spiral 14 can then also be removed from the drill shank 11.

Instead of a clamping ring in the design as a two-lug hose clamp, every other form of hose clamp can also be used.

The invention is not restricted to the exemplary embodiment. On the contrary, it also comprises all expert further developments and configurations of the invention.

What is claimed is:

1. In a drilling tool which includes a drill shank with a drill head, said drill shank including an outer surface having a first diameter; an interchangeable conveying spiral having first and second ends, said spiral being coaxially disposed on said shank; and an axial supporting means disposed at said second end for axially supporting said spiral, the improvement wherein:

said drill shank has a recessed groove, said recessed groove being circumferentially disposed around said drill shank and defining a second diameter of said drill shank less than said first diameter, and said axial supporting means including an elastic sleeve in said groove, said sleeve having a surface for abutting said second end of said spiral, the drilling tool further comprising a means for clamping said sleeve in said recessed groove.

2. A drilling tool as defined in claim 1, wherein said inner diameter of said sleeve is approximately equal to said first diameter of said drill shank and said means for clamping prevents radial expansion of said sleeve by pressing said sleeve into said recessed groove.

3. A drilling tool as defined in claim 1, wherein said sleeve has an inner diameter, and a bearing shoulder adjacent said second end of said spiral, said inner diameter being adapted to said second diameter of said drill shaft and said surface being formed on said bearing shoulder.

4. A drilling tool as defined in claim 3, wherein said axial sleeve has a retaining shoulder and said means for clamping is axially secured by said retaining shoulder and said bearing shoulder.

5. A drilling tool as defined in claim 3, wherein said means for clamping is a support ring.

6. A drilling tool as defined in claim 3, wherein said means for clamping is a clamping ring.

7. A drilling tool as defined in claim 3, wherein said means for clamping is a clamping strap.

8. A drilling tool as defined in claim 3, wherein said means for clamping is a two-lug hose clamp.

9. A drilling tool as defined in claim 3, wherein said sleeve is made of rubber.

10. A drilling tool as defined in claim 3, wherein said sleeve is made of plastic.

11. A drilling tool as defined in claim 1, wherein said clamping means surrounds said sleeve so as to prevent expansion of said sleeve.

12. A drilling tool as defined in claim 1 wherein said first end is supported by said drill head.

* * * * *